United States Patent [19]

Fujimoto et al.

[11] Patent Number: 4,926,807

[45] Date of Patent: May 22, 1990

[54] IGNITION SIGNAL DISTRIBUTING CIRCUIT FOR ENGINE

[75] Inventors: Takanori Fujimoto; Toshirou Hara, both of Himeji, Japan

[73] Assignee: Mitsubishi Denki Kabushiki Kaisha, Tokyo, Japan

[21] Appl. No.: 356,165

[22] Filed: May 24, 1989

[30] Foreign Application Priority Data

Jun. 3, 1988 [JP] Japan ..... 63-137996

[51] Int. Cl.[5] ..... F02P 9/00

[52] U.S. Cl. ..... 123/179 BG; 123/414

[58] Field of Search ..... 123/414, 424, 179 BG, 123/643

[56] References Cited

U.S. PATENT DOCUMENTS

| | | | |
|---|---|---|---|
| 2,398,259 | 4/1946 | Slayton | 123/179 BG |
| 2,478,739 | 8/1949 | Beck | 123/179 BG |
| 4,020,816 | 5/1977 | Chateau | 123/179 BG |
| 4,327,687 | 5/1982 | Haubner et al. . | |
| 4,422,421 | 12/1983 | Ezoe | 123/179 BG |
| 4,490,620 | 12/1984 | Hansen | 123/179 BG |
| 4,528,972 | 7/1985 | de Beaumont | 123/179 BG |
| 4,664,082 | 5/1987 | Suzuki | 123/414 |
| 4,690,123 | 9/1987 | Kimura | 123/414 |
| 4,694,799 | 9/1987 | Yagi | 123/179 BG |
| 4,726,347 | 2/1988 | Sasaki | 123/643 |
| 4,747,382 | 5/1988 | Suzuki | 123/414 |

FOREIGN PATENT DOCUMENTS

| | | | |
|---|---|---|---|
| 0160558 | 9/1983 | Japan | 123/179 BG |

*Primary Examiner*—Carl Stuart Miller

*Attorney, Agent, or Firm*—Sughrue, Mion, Zinn, Macpeak and Seas

[57] ABSTRACT

An ignition signal distributing circuit for a multicyclinder engine in accordance with the present invention comprises a delay circuit which delays an output signal of a crank angle sensor or a cranking switch signal for the duration until the first output signal of the crank angle sensor is completed in the early stage of the time immediately after a starting of power supplying, and thereby an output of an error ignition signal can be prevented which is caused by that the crank angle sensor outputs a detection signal when power supplying is started.

4 Claims, 7 Drawing Sheets

| S | $\overline{R}$ | $\overline{Q}$ |
|---|---|---|
| 0 | 0 | 1 |
| 0 | 1 | * |
| 1 | 0 | 1 |
| 1 | 1 | 0 |

IGNITION SIGNAL DISTRIBUTING CIRCUIT FOR ENGINE

BACKGROUND OF THE INVENTION

1. Field of the Invention

The present invention relates to a circuit for distributing an ignition signal on every cylinder individually of a multicylinder engine principally for automobile.

2. Description of the Prior Art

FIG. 1 shows a configuration of a conventional ignition signal distributing circuit for a multicylinder engine.

FIG. 1, numeral 1 designates an $\overline{R}S$ flip-flop having a reset input terminal $\overline{R}$ of negative logic. An output signal $S_G$ of a cylinder identifying sensor 50 of an engine (not shown) is inputted to an input terminal S of this $\overline{R}S$ flip-flop 1, and an output signal $S_{CR}$ of a crank angle sensor 51 is inputted to a reset input terminal $\overline{R}$ thereof, respectively.

The cylinder identifying sensor 50 identifies that a first cylinder and a fourth cylinder of the engine are to be ignited, and at this time, outputs a cylinder identification signal by turning the output signal $S_G$ to the logic level "1".

Also, the crank angle sensor 51 outputs a crank angle signal by turning the output signal $S_{CR}$ to "1" when each cylinder of the engine is positioned in a predetermined crank angle section.

In FIG. 1, numeral 2 designates an ignition signal arithmetic unit, which inputs the output signal $S_G$ of the cylinder identifying sensor 50 and the output signal $S_{CR}$ of the crank angle sensor 51, and operates and outputs signals for ignition signal Sc and Sd on the basis of information on the both signals.

Numeral 3 designates a two-input NAND gate, which inputs the output signal $S_{CR}$ of the crank angle sensor 51 and an output signal Sa from an inversion output terminal $\overline{Q}$ of the $\overline{R}S$ flip-flop 1, and outputs a signal Sb.

Numerals 4 and 5 designate two-input NOR gates, and numerals 6 and 7 designate AND gates of one-inversion-input type, and to one input terminal of each gate, a cranking switch signal $S_{SW}$ is inputted. Also, an output signal Sc of the ignition signal arithmetic unit 2 is inputted to the other input terminal of the NOR gate 4, and an output signal Sd of the ignition signal arithmetic unit 2 is inputted to the other input terminal of the NOR gate 5, respectively. The output signal Sa of the $\overline{R}S$ flip-flop 1 is inputted to the inversion input terminal of the one-inversion-input type AND gate 6, and the output signal Sb of the NAND gate 3 is inputted to the inversion input terminal of the one-inversion-input type AND gate 7, respectively.

Numeral 8 designates a two-input OR gate, whereto each output signal of the NOR gate 4 and the AND gate 6 is inputted. This OR gate 8 distributes a first ignition signal $S_{IG1}$ to the first cylinder #1 and the fourth cylinder #4 of the engine.

Also, numeral 9 designates a two-input OR gate, whereto each input signal of the NOR gate 5 and the AND gate 7 is inputted. This OR gate 9 distributes a second ignition signal $S_{IG2}$ to the second cylinder #2 and the third cylinder #3 of the engine.

FIG. 2 is a table showing the state of the inversion output terminal $\overline{Q}$ responding to the both inputs of the $\overline{R}S$ flip-flop 1, that is, the state of the output signal Sa. Note that a mark "*" in the $\overline{Q}$ column shows that the state is the same as the previous state.

FIG. 3 is a waveform diagram showing a signal waveform at each position of the conventional ignition signal distributing circuit for engine shown in FIG. 1.

When power is turned on at a time t1, a cranking switch (not shown) for supplying power to a starter (not shown) is operated from OFF to ON at a time t2, and the cranking switch signal $S_{SW}$ is turned to "1". When the output signal $S_{CR}$ of the crank angle sensor 51 is kept intact at the level "0" at this time, thereafter the first and the second ignition signals $S_{IG1}$ and $S_{IG2}$ are outputted alternately at a predetermined timing from the OR gates 8 and 9.

Hereinafter, detailed description is made thereon.

In the case where the output signal $S_G$ of the cylinder identifying sensor 50 and the output signal $S_{CR}$ of the crank angle sensor 51 are both "0", the $\overline{Q}$ output signal Sa of the $\overline{R}S$ flip-flop 1 whereto the both signals are inputted is turned to "1". Thereafter, the signal Sa is not changed even when the output signal $S_{CR}$ of the crank angle sensor 51 is turned to "1".

In th case where the cranking switch signal $S_{SW}$ is "1", the NOR gates 4 and 5 are disabled, and the one-inversion-input type AND gates 6 and 7 are enabled. Also, the output signal Sb of the NAND gate 3 is turned to "0" only when both of the $\overline{Q}$ output signal Sa of the $\overline{R}S$ flip-flop 1 and the output signal $S_{CR}$ of the crank angle sensor 51 are "1". Accordingly, the output signal of the one-inversion-input type AND gate 7 turning the signal Sb from "0" to "1" is turned to "1", and the second ignition signal $S_{IG2}$ is outputted from the OR gate 9.

Also, in the case where the cranking switch signal $S_{SW}$ is "0", the NOR gates 4 and 5 are enabled, and the one-inversion-input type AND gates 6 and 7 are disabled. Accordingly, when the signal Sd is "0", the output of the NOR gate 5 is turned to "1", and the second ignition signal $S_{IG2}$ is outputted from the OR gate 9.

The signal Sd has nearly the same phase and the same waveform as those of the signal Sb.

Also, the $\overline{Q}$ output signal Sa of the $\overline{R}S$ flip-flop 1 is turned to "1" when both of the signals $S_G$ and $S_{CR}$ to the $\overline{R}S$ flip-flop 1 are "0", and thereafter it is turned to "0" when the output signal $S_G$ of the cylinder identifying sensor 50 and the output signal $S_{CR}$ of the crank angle sensor 51 are both turned to "1", and is turned again to "1" when the output signal $S_{CR}$ of the crank angle sensor 51 is turned to "0".

In the case where the cranking switch signal $S_{SW}$ is "1", when the output signal Sa of the $\overline{R}S$ flip-flop 1 is "0", the output of the one-inversion-input type AND gate 6 is turned to "1", and the first ignition signal $S_{IG1}$ is outputted from the OR gate 8.

Also, in the case where the cranking switch signal $S_{SW}$ is "0", if the signal Sc is "0", the output signal of the NOR gate 4 is turned to "1", and the first ignition signal $S_{IG1}$ is outputted from the OR gate 8.

The signal Sc has nearly the same phase and the same waveform as those of the signal Sa.

The conventional ignition signal distributing circuit for engine is constituted as described above, and therefore, for example, as shown in FIG. 4, power is turned on at a timer t3, and thereafter the cranking switch signal $S_{SW}$ is turned to ON ("1") at a time t5 before a time t6, and the output signal $S_{CR}$ of the crank angle sensor 51 is turned to "1" between the time t3 and the time t6. Between the time t3 and the time t6, "0" is inputted to the set input terminals of the $\overline{R}S$ flip-flop 1, and "1" is inputted to the inversion reset input terminal $\overline{R}$ thereof. In this case, the $\overline{Q}$ output signal Sa of the $\overline{R}S$ flip-flop 1 becomes *, and can take either value, "0" or "1". Assuming that it is turned to "0", since the output signal of the one-inversion-input type AND gate 6 depends on the cranking switch signal $S_{SW}$, it is turned to "1" between the time t5 and the time t6. Consequently, the first ignition signal $S_{IG1}$ of "1" is outputted from the OR gate 8, and thereafter at the time t6, the both input signals $S_G$ and $S_{CR}$ of the $\overline{R}S$ flip-flop 1 are turned to "0", and therefore the $\overline{Q}$ output signal Sa is turned to "1", and the output of the one-inversion-input type AND gate 6 is turned to "0", and therefore the output of the OR gate 8 is turned to "0". For this reason, a problem is raised that the first ignition signal $S_{IG1}$ is generated during a duration of time between t5 and t6 when normally operating, the first ignition signal $S_{IG1}$ must not be generated.

SUMMARY OF THE INVENTION

The present invention has been achieved in the light of such circumstances, and a principal object thereof is to provide an ignition signal distributing circuit for engine capable of avoiding an occurrence of an error ignition signal of an engine.

An ignition signal distribution circuit for a multicylinder engine in accordance with the present invention comprises a cylinder identifying sensor which identifies that predetermined cylinder of the engine is to be ignited and outputs a cylinder identification signal, a crank angle sensor which detects that the crank angle of the engine is a predetermined angle and outputs a crank angle signal, a flip-flop which is inputted output signals of the both sensors, an arithmetic circuit which distributes ignition signals to the engine every cylinder individually on the basis of based on output signals of the both sensors, output signals of the flip-flop and engine starting information, and a delay circuit which delays the output signal of the crank angle sensor or the starting information for the duration from the starting of power supplying to the to completion of the above-mentioned first output signal of the crank angle sensor. In accordance with such a configuration, in the case where the crank angle signal is generated at the starting of power supplying, the signal is delayed by the delay circuit, so that no error signal is generated at all.

The above and further objects and features of the invention will more fully be apparent from the following detailed description with accompanying drawings.

DESCRIPTION OF THE PREFERRED EMBODIMENTS

Hereinafter, detailed description is made on the present invention in reference to drawings showing embodiments thereof.

Figure 5:
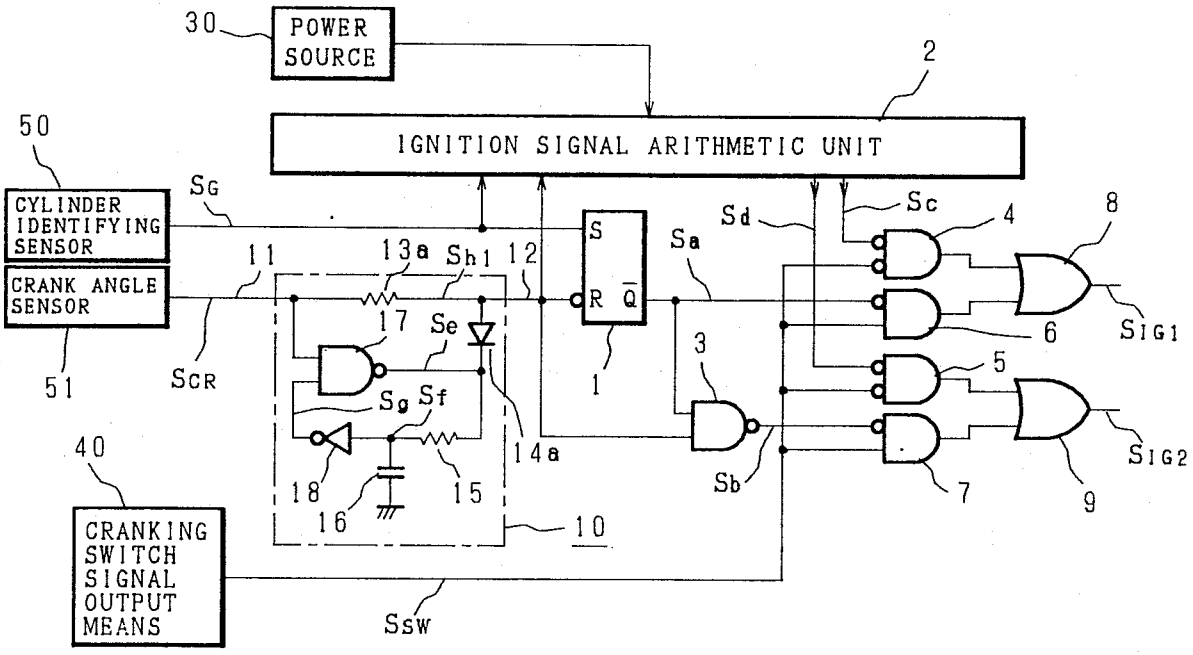
FIG. 5 is a circuit diagram showing a first embodiment of a configuration of an ignition signal distributing circuit for engine in accordance with the present invention.

FIG. 5 shows a first embodiment of a configuration of an ignition signal distributing circuit for a multicylinder engine in accordance with the present invention. In addition, the same reference symbols are given to the portions being same as or corresponding to those of the conventional example as shown in the above-mentioned FIG. 1.

In FIG. 5, numeral 1 designates an $\overline{R}S$ flip-flop having a negative-logic reset input terminal $\overline{R}$.

An output signal $S_G$ of a cylinder identifying sensor 50 of a multicylinder engine (not illustrated) is inputted to a set input terminal S of this $\overline{R}S$ flip-flop 1 and an output signal $S_{CR}$ of a crank angle sensor 51 is inputted to the reset input terminal $\overline{R}$ through a delay circuit 10 as described later, respectively.

The cylinder identifying sensor 50 identifies that a first cylinder and a fourth cylinder of the engine are to be ignited, and at that time, turns the output signal $S_G$ to the logic level "1" to output a cylinder identifying signal.

Also, the crank angle sensor 51 outputs a crank angle signal by turning the output signal $S_{CR}$ thereof to "1" in the case where each cylinder of the engine is positioned in a predetermined crank angle section.

In FIG. 5, numeral 2 designates an ignition signal arithmetic unit, which inputs the output signal $S_G$ of the cylinder identifying sensor 50, inputs the output signal $S_{CR}$ of the crank angle sensor 51 through the delay circuit 10, and operates and outputs signals for ignition signals Sc and Sd on the basis of information on the both signals.

Numeral 3 designates a two-input NAND gate, which inputs the output signal $S_{CR}$ of the crank angle sensor 51 and the output signal Sa from an inversion-output terminal $\overline{Q}$ of the $\overline{R}S$ flip-flop 1, and outputs a signal Sb.

Numerals 4 and 5 designate two-input NOR gates, and numerals 6 and 7 designate one-inversion input type AND gates, and a cranking switch signal $S_{SW}$ outputted from a cranking switch signal output means is inputted to a one-input terminal of each gate. Also, an output signal Sc of the ignition signal arithmetic unit 2 is inputted to the other input terminal of the NOR gate 4, and an output signal Sd of the ignition signal arithmetic unit 2 is inputted to the other input terminal of the NOR gate 5, respectively. A $\overline{Q}$ output signal Sa of the $\overline{R}S$ flip-flop 1 is inputted to an inversion-input terminal of the one-inversion-input type AND gate 6 and an output signal Sb of a NAND gate 3 is inputted to an inversion-input-terminal of the one-inversion-input type AND gate 7, respectively.

Numeral 8 designates a two-input OR gate, whereto each output signal of the NOR gate 4 and the AND gate 6 are inputted. This OR gate 8 distributes a first ignition signal $S_{IG1}$ to a first cylinder #1 and the fourth cylinder #4 of the engine.

Also, numeral 9 designates a two-input OR gate, whereto each signal of the NOR gate 5 and the AND gate 7 are inputted. This OR gate 9 distributes a second ignition signal $S_{IG2}$ to the second cylinder #2 and the third cylinder #3 of the engine.

Straightforwardly, in the delay circuit 10, the output signal $S_{CR}$ of the crank angle sensor 51 is outputted to an input terminal 11, and the output signal $S_{CR}$ of the level "1" of the crank angle sensor 51 is removed at the beginning of turn-on of power, and thereafter an output signal Sh1 of the same phase and the same waveform as those of the output signal $S_{CR}$ of the crank angle sensor 51 is outputted to an output terminal 12. This output terminal 12 is connected to the inversion-reset-input terminal $\overline{R}$ of the $\overline{R}S$ flip-flop 1, one of input terminals of the ignition signal arithmetic unit 2, and one of input terminals of the NAND gate 3, respectively.

In other words, in the conventional ignition signal distributing circuit for engine, the output signal $S_{CR}$ of the crank angle sensor 51 is inputted directly to the reset-input terminal $\overline{R}$ of the $\overline{R}S$ flip-flop 1, one of the input terminals of the ignition signal arithmetic unit 2 and one of the input terminals of the NAND gate 3, but in this embodiment, it is inputted through the delay circuit 10.

In addition, numeral 30 designates a power source for power supplying to this circuit.

Hereinafter, detailed description is made on the delay circuit 10.

Numeral 13*a* designates a resistor connected between the both terminals 11 and 12.

Also, a diode 14*a*, a resistor 15 and a capacitor 16 are connected in series between the terminal 12 and the ground level.

Numeral 17 designates a NAND gate, wherein one of input terminals is connected to the input terminal 11 of the delay circuit 10, and the other input terminal is connected to an output terminal Q of an inverter 18 connected to the nongrounded side of the capacitor 16. Also, the output terminal of this NAND gate 17 is connected to a node point of the diode 14*a* and the resistor 15.

In addition, symbol Se designates an output signal of NAND gate 17, symbol Sf designates the voltage level of the capacitor 16 and symbol Sg designates an output signal of the inverter 18.

Figures 1, 2:
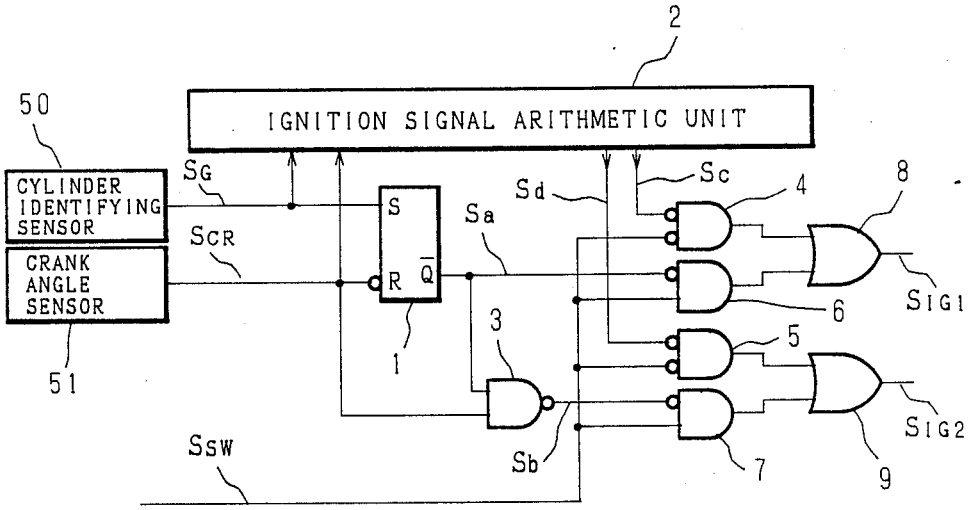
Fig. 1 Prior Art
Fig. 2 Prior Art
FIG. 1 is a circuit diagram showing a configuration of a conventional ignition signal distributing circuit for engine.
FIG. 2 is a truth table of a flip-flop thereof.

Also, the state of the inversion-output terminal $\overline{Q}$ responding to the both input signals of the $\overline{R}S$ flip-flop 1, that is, the state of the output signal Sa is similar to the above-described conventional example shown in FIG. 2.

Next, description is made on operation of the ignition signal distributing circuit for engine of the present invention comprising the delay circuit 10 as described above.

Figure 6:
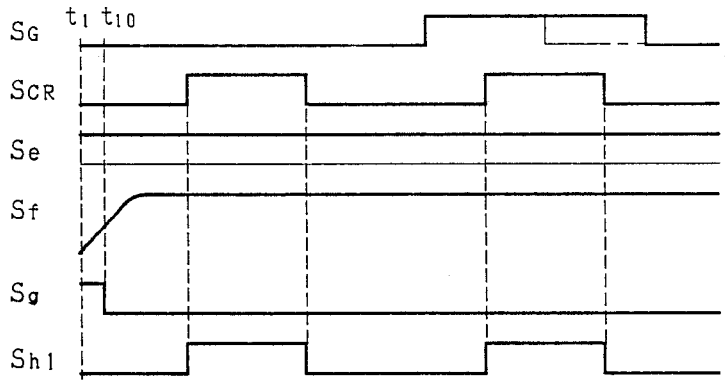
FIG. 6 and FIG. 7 are waveform graphs of signals thereof.

FIG. 6 is a waveform graph showing signal waveforms at each position of the ignition signal distributing circuit for an engine of the present invention shown in FIG. 5.

When power is turned on by the power source 30 at a time t1, the output signal $S_{CR}$ of the crank angle sensor 51 is "0". Consequently, an output Se of the NAND gate 17 is turned to "1", and the capacitor 16 starts to be charged through the resistor 15. Thereafter, at a time t10, a voltage level Sr of the capacitor 16 reaches a predetermined level, and the output signal Sg of the inverter 18 is inverted from "1" to "0". The output signal Se of the NAND gate 17 whereto the output signal Sg of the inverter 18 is inputted is kept at the level "1" even when the output signal $S_{CR}$ of the crank angle sensor 51 is turned to "1" at and after the time t10.

Thereby, even if the output signal $S_{CR}$ of the crank angle sensor 51 is turned to "1", it is outputted intact as the signal Sh1 to the output terminal 12 of the delay circuit 10 through the diode 14*a* without being pulled down.

Figure 3:
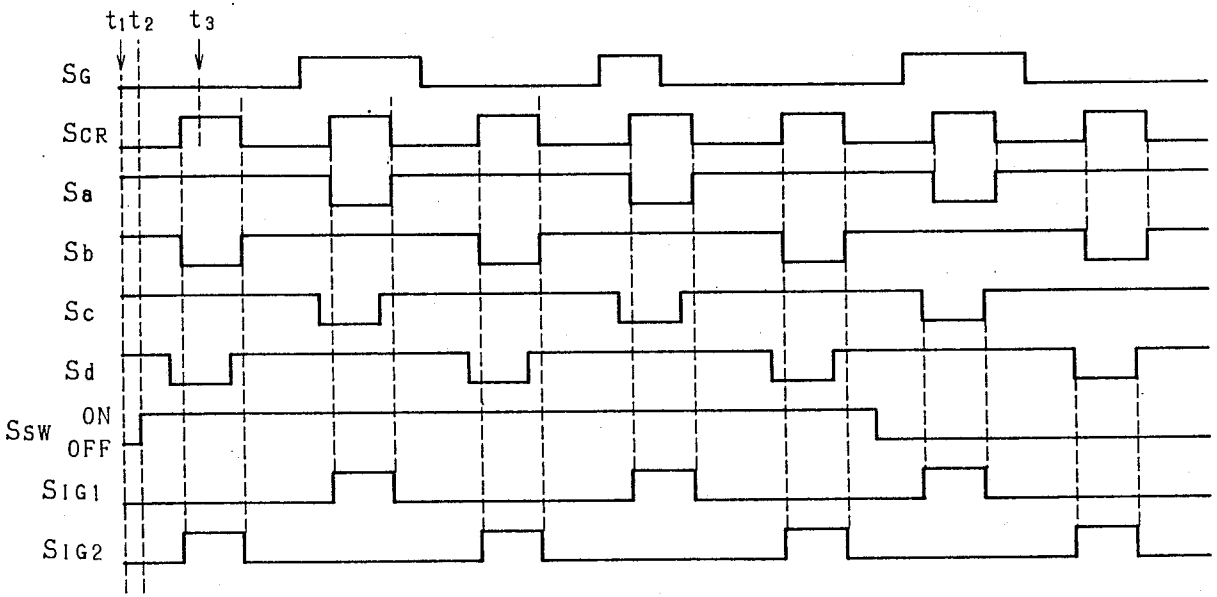
Fig. 3 Prior Art
FIG. 3 and FIG. 4 are waveform graphs of signals of a conventional apparatus.
Figure 4:
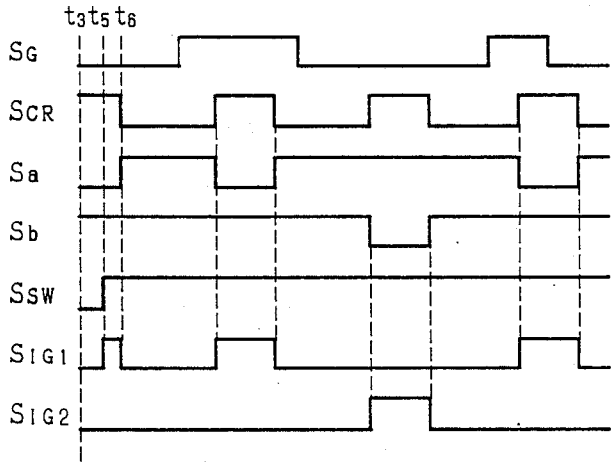
Fig. 4 Prior Art

Accordingly, the output signal $S_{CR}$ of the crank angle sensor 51 and the output signal Sh1 of the delay circuit 10 have the same phase and the same waveform, and therefore the waveform graph is similar to the waveform graph of the conventional example shown in FIG. 3.

Figure 7:
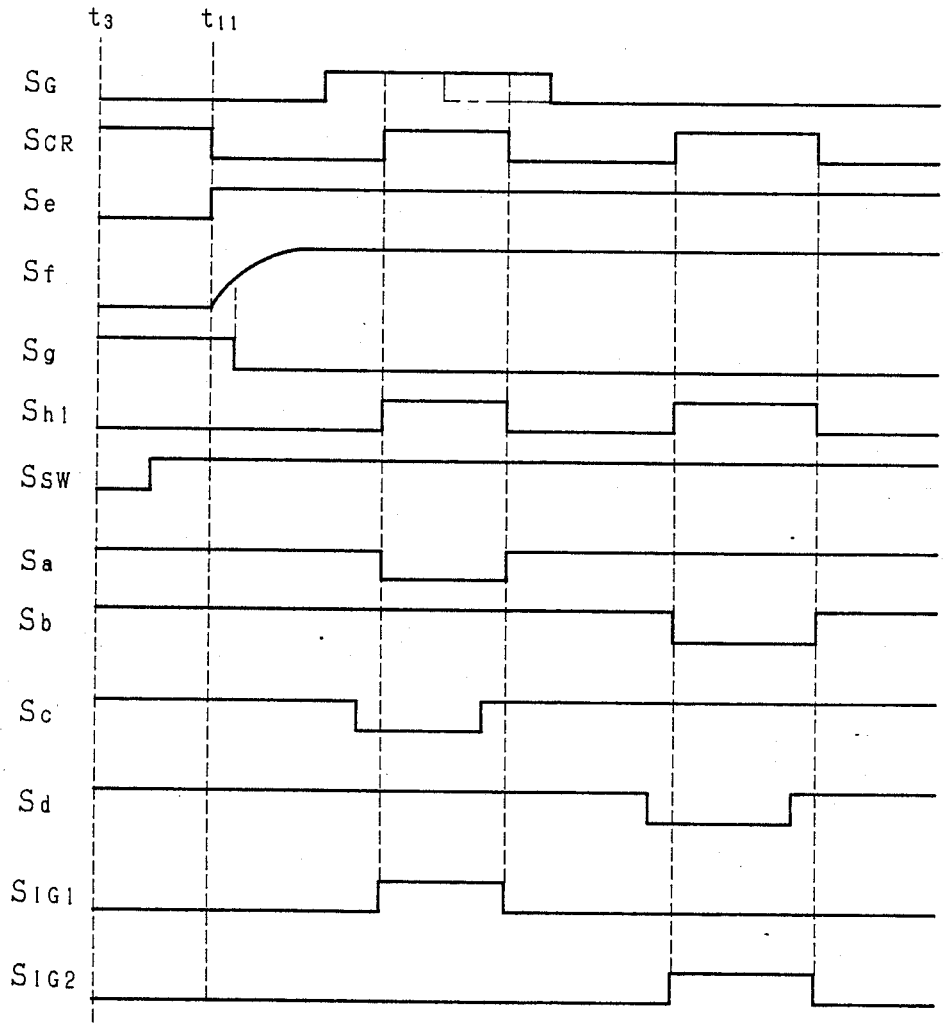

Next, in FIG. 7, power is assumed to be turned on by the power source 30 at a time t3. The output signal $S_{CR}$ of the crank angle sensor 51 is kept at "1" from the time t3 to a time t11. Also, the voltage level Sr of the capacitor 16 is "0", and therefore the output signal Sg of the inverter 18 is turned to "1". Accordingly, the output signal Se of the NAND gate 17 is turned to "0", and the capacitor 16 is never charged.

The level "1" of the output signal $S_{CR}$ of the crank angle sensor 51 during a duration of time from t3 to t11 is pulled down through the resistor 13*a* and the diode 14*a*, and therefore the output signal Sh1 of the delay circuit 10 is turned to "0".

Thereafter, at the time t11, the output signal $S_{CR}$ of the crank angle sensor 51 is turned to "0". The operation at and after the time t11 is similar to the operation at and after the time t1 in FIG. 6.

Thus, as is understood by comparison with the waveform graph of the above-described conventional example shown in FIG. 3, even if the cranking switch signal $S_{SW}$ has been turned on from a turn-on of power, an error ignition signal is never generated because the output signal Sh1 of the delay circuit 10 is kept at "0" at the beginning.

In addition, the operation at and after the time t11 is similar to the operation at and after the time t3 in FIG. 3, and therefore the first and the second ignition signals $S_{IG1}$ and $S_{IG2}$ are outputted alternately at a predetermined proper timing.

Figure 8:
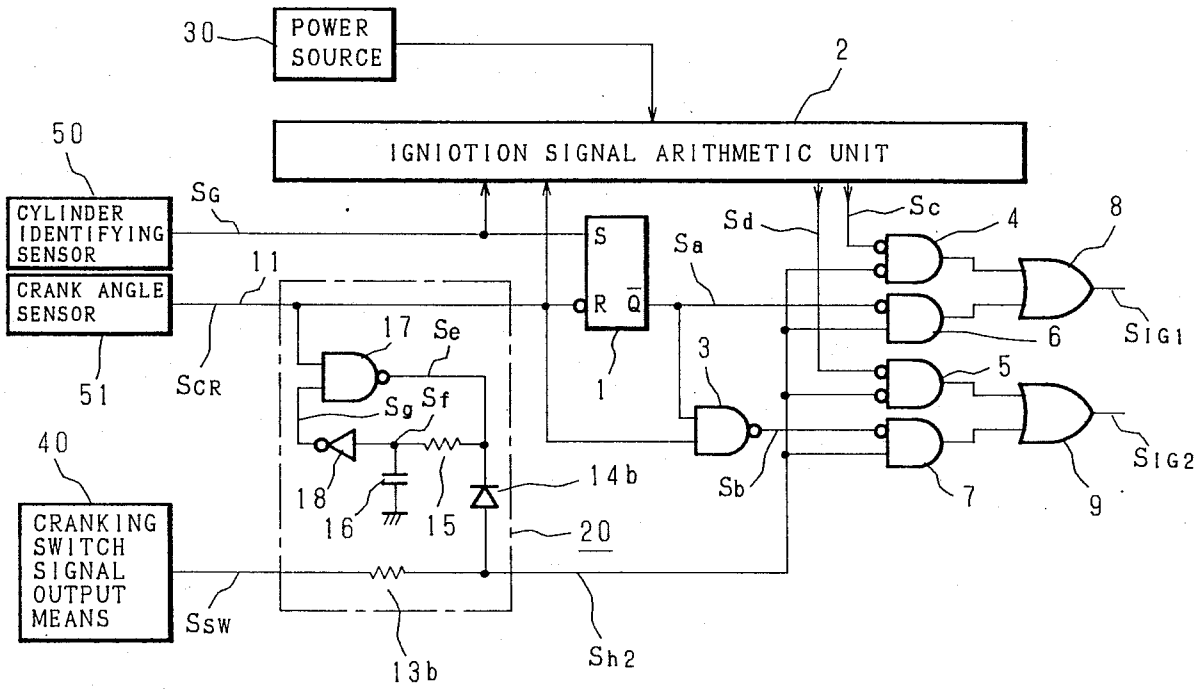
FIG. 8 is a circuit diagram of a second embodiment of the configuration of the ignition signal distributing circuit for engine in accordance with the present invention.

FIG. 8 is a view showing a second embodiment of the configuration of the ignition signal distributing circuit for an engine of the present invention.

A difference of this second embodiment from the first embodiment shown in FIG. 1 is the node of a resistor 13*b* and a diode 14*a* to an input line of the cranking switch signal $S_{SW}$ in place of the node of the resistor 13*b* and the diode 14*b* to an input line of the output signal $S_{CR}$ of the crank angle sensor 51.

A configuration of a delay circuit 20 comprising the input terminal 11, the resistor 13*b*, the diode 14*b*, the resistor 15, the capacitor 16, the NAND gate 17 and the inverter 18 is similar to that of the first embodiment.

Figure 9:
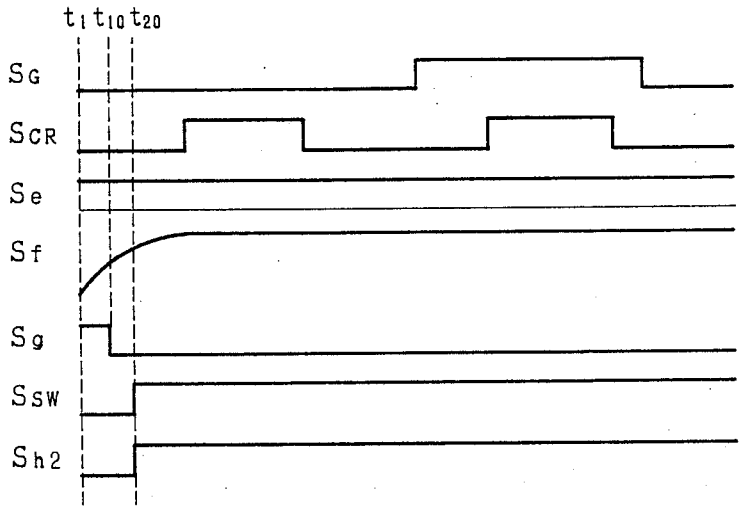
FIG. 9 and FIG. 10 are waveform graphs of signals thereof.

Operation of the second embodiment having such a configuration is described as follows in reference to waveforms in FIG. 9 and FIG. 10.

Likewise the waveform graph of the first embodiment shown in FIG. 6, in FIG. 8, the output signal Se of the NAND gate 17 is kept at "1" from a turn-on of power, and therefore even if the cranking switch signal $S_{SW}$ is turned to "1" at a time t20 after the time t1, the output signal $S_{CR}$ of the crank angle sensor 51 is not pulled down through the resistor 13*b* and the diode 14*b*, and the same is true of the operation at and after the time t20. Accordingly, a signal Sh2 at the time when the cranking switch signal $S_{SW}$ has passed through the resistor 13*b* is the same as the cranking switch signal $S_{SW}$, and the same waveform graph as that of the conventional examples shown in FIG. 3 is obtained.

Figure 10:
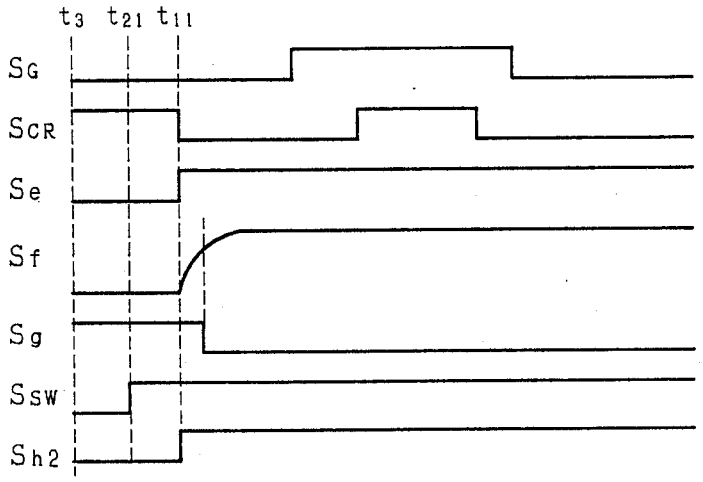

Also, likewise the waveform graph of the first embodiment shown in FIG. 7, in FIG. 10, the output signal Se of the NAND gate 17 is "0" during a duration of time from a turn-on of power t3 to t11, and thereafter it is turned to "1". When the cranking switch signal $S_{SW}$ is turned to "1" at a time t21 between the time t3 and the time t11, it is pulled down through the resistor 13*b* and the diode 14*b*, and therefore the signal Sh2 is turned to "0". Thereafter this state is continued intact, and at and after the time t11, the output signal Se of the NAND gate 17 is turned to "1" likewise the case of the first embodiment shown in FIG. 7, and therefore the cranking switch signal $S_{SW}$ of "1" is not pulled down, and the signal Sh2 is turned to "1".

Accordingly, in the early period of time from a turn-on of power t3 to t11, when the output signal $S_{CR}$ of the crank angle sensor 51 is "1", the signal Sh2 becomes "0", and therefore both of the one-inversion-input type AND gates 6 and 7 are disabled, and an error ignition signal is never generated.

As described above, in accordance with the present invention, even when the output signal $S_{CR}$ of the crank angle sensor 51 is generated at the time of a turn-on of power, it is disabled by the delay circuit 10 (20), and therefore the output signal $S_{CR}$ is never outputted from the crank angle sensor 51 in the early period of time. Accordingly, an accurate timing of ignition at engine starting is assured, and even a limited timing of ignition can be reflected reliably.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. An ignition signal distributing circuit for a multi-cylinder engine comprising:
   - a power source for power supplying;
   - a cylinder identifying sensor which identifies that a predetermined cylinder is to be ignited and outputs a signal in response to a detected result;
   - a means for outputting an engine starting information when said engine is started up;
   - a crank angle sensor which detects a predetermined crank angle and outputs a signal in response to the detected crank signal;
   - a flip-flop which is inputted output signals of said both sensors;
   - an arithmetic circuit which distributes ignition signals to every cylinder of said engine individually on the basis of output signals of said both sensors, the output of said flip-flop and said engine starting information; ;and
   - a delay circuit which delays the output signal of said crank angle sensor for the duration from the starting of power supplying by said power source to a completion of the first output signal of said crank angle sensor.

2. An ignition signal distributing circuit for engine as set forth in claim 1, wherein said engine starting information is a cranking switch signal.

3. An ignition signal distributing circuit for a multi-cylinder engine comprising:
   - a power source for power supplying;
   - a cylinder identifying sensor which identifies that a predetermined cylinder is to be ignited and outputs a signal in response to a detected result;
   - a means for outputting an engine starting information when said engine is started up;
   - a crank angle sensor which detects a predetermined crank angle and outputs a signal in response to the detected crank signal;
   - a flip-flop which is inputted output signals of said both sensors;
   - an arithmetic circuit which distributes ignition signals to every cylinder of said engine individually on the basis of output signals of said both sensors, the output of said flip-flop and said engine starting information; and
   - a delay circuit which delays said engine starting information for the duration from the starting of power supplying by said power source to a completion of the first output signal of said crank angle sensor.

4. An ignition signal distributing circuit for engine as set forth in claim 3, wherein said engine starting information is a cranking switch signal.

* * * * *